US005604475A

United States Patent [19]

Jackson

[11] Patent Number: 5,604,475

[45] Date of Patent: Feb. 18, 1997

[54] CURRENT-LIMITING FUSE AND HOUSING ARRANGEMENT

[75] Inventor: Hiram S. Jackson, Morton Grove, Ill.

[73] Assignee: S&C Electric Company, Chicago, Ill.

[21] Appl. No.: 225,161

[22] Filed: Apr. 7, 1994

[51] Int. Cl.[6] ..... H01H 85/04; H01H 71/10

[52] U.S. Cl. ..... 337/159; 337/168; 337/176; 337/171

[58] Field of Search ..... 337/297, 290, 337/291, 292, 295, 296, 159, 158, 168, 169, 170, 171, 172, 173, 174–181

[56] References Cited

U.S. PATENT DOCUMENTS

| | | | |
|---|---|---|---|
| 737,284 | 8/1903 | Sachs | 337/292 |
| 2,143,037 | 1/1939 | Smith | 337/290 |
| 2,263,752 | 11/1941 | Babler | 337/297 |
| 3,134,874 | 5/1964 | Cameron | 200/120 |
| 3,394,333 | 7/1968 | Jacobs, Jr. | 337/229 |
| 3,479,630 | 11/1969 | Kozacka | 337/159 |
| 3,524,157 | 8/1970 | Salzer | 337/159 |
| 3,571,776 | 3/1971 | Kozacka et al. | 337/161 |
| 3,630,219 | 12/1971 | Kozacka | 337/161 |
| 3,648,210 | 3/1972 | Kozacka | 337/161 |
| 3,671,909 | 6/1972 | Kozacka et al. | 337/160 |
| 3,671,910 | 6/1972 | Kozacka | 337/146 |
| 3,673,533 | 6/1972 | Salzer | 337/161 |
| 3,713,064 | 1/1973 | Jacobs, Jr. | 337/161 |
| 3,764,949 | 10/1973 | Swain et al. | 337/244 |
| 3,766,507 | 10/1973 | Jacobs, Jr. | 337/161 |
| 3,827,010 | 7/1974 | Cameron et al. | 337/168 |
| 3,863,187 | 1/1975 | Mahieu et al. | 337/162 |
| 3,893,056 | 7/1975 | Harner | 337/283 |
| 3,986,157 | 10/1976 | Salzer et al. | 337/186 |
| 4,011,537 | 3/1977 | Jackson, Jr. et al. | 337/171 |
| 4,020,441 | 4/1977 | Jacobs, Jr. | 337/187 |
| 4,101,820 | 7/1978 | Montanari | 337/297 |
| 4,121,187 | 10/1978 | Mahieu | 337/292 |
| 4,140,988 | 2/1979 | Oakes | 337/297 |
| 4,161,713 | 7/1979 | Jacobs, Jr. | 337/161 |
| 4,167,723 | 9/1979 | Wilks | 337/273 |
| 4,184,138 | 1/1980 | Beard et al. | 337/168 |
| 4,309,684 | 1/1982 | Wilks | 337/273 |
| 4,366,461 | 12/1982 | Tawfik | 337/159 |
| 4,692,734 | 9/1987 | Swanson et al. | 337/162 |
| 5,274,349 | 12/1993 | Hassler et al. | 337/171 |
| 5,293,147 | 3/1994 | Oh | 337/290 |
| 5,357,234 | 10/1994 | Pimpis et al. | 337/246 |
| 5,426,411 | 6/1995 | Pimpis et al. | 327/186 |

FOREIGN PATENT DOCUMENTS 1001698 12/1976 Canada .

*Primary Examiner*—Leo P. Picard
*Assistant Examiner*—Stephen T. Ryan
*Attorney, Agent, or Firm*—James V. Lapacek

[57] ABSTRACT

A current-limiting device is provided having a low profile configuration (generally flat polyhedron) that defines a cavity of predetermined dimensions and an elongated circuitous path through the cavity. The device also includes provisions for supporting a current-limiting fusible element along the path. The cavity is filled with a pulverulent arc-quenching filler material. In one specific arrangement, the path of the fusible element is defined by one or more U-shaped sections substantially spanning the length or width of the cavity. The fusible element is arranged in a predetermined geometry to include a length of the fusible element that is longer than the overall straight-line path via a configuration of steps or bends along its length.

14 Claims, 3 Drawing Sheets

CURRENT-LIMITING FUSE AND HOUSING ARRANGEMENT

BACKGROUND OF THE INVENTION

1. Field of the Invention

The present invention relates generally to the field of current-limiting fuses for electrical power distribution systems and more particularly to an improved current limiter and housing arrangement that provides an overall small, low-profile housing configuration that is desirable both from the manufacturing and product use perspectives.

2. Description of Related Art

Various current-limiting fuse arrangements are known in the prior art including a variety of housing configurations and a variety of current-limiting fusible elements having predetermined hole patterns and ribbon geometry. For example, the following U.S. Patents and the noted Canadian Patent are directed to fuses having tubular housings with fusible elements of various configurations extending through the housing along diverse geometrical paths: U.S. Pat. Nos. 3,134,874; 3,394,333; 4,309,684; 4,366,461; 3,571,776; 3,630,219; 3,648,210; 3,671,909; 3,863,187; 4,020,441; 4,161,713; 4,167,723; and 4,692,734, and Canadian Patent 1,001,698.

Another group of U.S. Patents is directed to fuse apparatus enclosed within cubical or prismatic housings and having a plurality of fusible elements which are connected electrically in parallel and which are oriented in generally parallel (or equally spaced) relationship to each other: U.S. Pat. Nos. 3,671,910; 3,673,533; 3,713,064; 3,764,949; and 3,766,507. Further, patent, U.S. Pat. No. 3,986,157, is directed to a fuse arrangement with a prismatic housing and a fusible element formed by a channel-shaped ribbon of sheet metal which spans the interior of the prismatic housing.

These current-limiting fuses may be used in various circuit applications either as individual fuse components at particular locations in a circuit network or in combination with other fuses and circuit-interrupters. For example, a current-limiting fuse is provided in series circuit with a power fuse or cutout as illustrated in the aforementioned U.S. Pat. No. 3,863,187. The current-limiting fuse is mounted separately from and adjacent to the cutout mounting. It should be noted that the current-limiting fuse in U.S. Pat. No. 3,863,187 is relatively large and heavy. Additionally, current-limiting fuses are shown in combination with other fuses as composite fuse arrangements in U.S. Pat. Nos. 3,893,056, 4,011,537, 3,827,010, and 4,184,138.

While the prior art arrangements may be generally useful as current-limiting devices for the electrical distribution field, it is desirable to provide devices with more optimized housing dimensions, configurations, and overall volumes which offer ease and economy of manufacturing.

SUMMARY OF THE INVENTION

Accordingly, it is a principal object of the present invention to provide a current-limiting device in an optimized configuration having a low volume including a path for a current-limiting element that is much longer than the length and width of the device.

It is another object of the present invention to provide a current-limiting fuse that is economical to manufacture via the provisions of a molded housing of low-profile configuration.

It is a further object of the present invention to provide a current-limiting fuse that defines an elongated circuitous planar path for a fusible element defined by a plurality of serially interconnected non-aligned segments that generally define a plane.

It is an additional object of the present invention to provide a current-limiting fuse that defines an elongated circuitous planar path for a fusible element including two or more U-shaped portions.

It is a still further object of the present invention to provide a current-limiting fuse having at least two housing portions of thermoplastic material with the housing portions being assembled via vibration welding to form a continuous bond at their interfaces so as to provide a sealed housing.

It is yet another object of the present invention to provide a current-limiting fuse having an elongated fusible element arranged over a predetermined path that includes a large number of closely spaced bends or undulations out of the path to maximize the length of the overall fusible element, each of the closely spaced bends or undulations being defined by at least three adjoining segments that are out of the path of the fusible element and that do not intersect the path.

It is an additional object of the present invention to provide a current-limiting fuse having an elongated fusible element arranged over a predetermined path within a fulgarite-forming material wherein the path includes a pattern of areas of reduced cross-section that are closely spaced so as to reduce the required volume of surrounding fulgarite-forming material via the achievement of uniform fulgarite sites of minimal size.

It is still another object of the present invention to provide a current limiter in a small low-profile housing configuration having an elongated fusible element within a fulgarite-forming material, the path of the fusible element being arranged to optimize the use of the fulgarite-forming filler material and to minimize the volume of the housing while still providing a housing that is easy to manufacture.

These and other objects of the present invention are efficiently achieved by the provision of a current-limiting device having a low profile configuration (generally flat polyhedron) that defines a cavity of predetermined dimensions and an elongated circuitous path through the cavity. The device also includes provisions for supporting a current-limiting fusible element along the path. The cavity is filled with a pulverulent arc-quenching filler material. In one specific arrangement, the path of the fusible element is defined by one or more U-shaped sections substantially spanning the length or width of the cavity. The fusible element is arranged in a predetermined geometry to include a length of the fusible element that is longer than the overall straight-line path via a configuration of steps or bends along its length.

BRIEF DESCRIPTION OF THE DRAWING

The invention, both as to its organization and method of operation, together with further objects and advantages thereof, will best be understood by reference to the specification taken in conjunction with the accompanying drawing in which.

DETAILED DESCRIPTION

Figure 1:
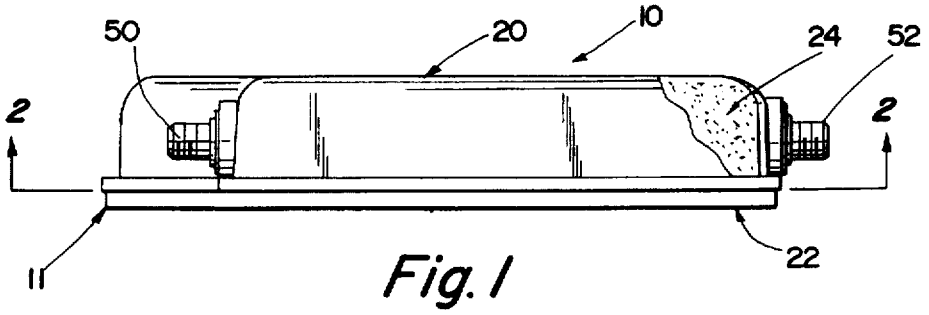
FIG. 1 is an elevational view of the fuse arrangement of the present invention.

Referring now to FIGS. 1–5 and a specific, illustrative example of the present invention, the fuse arrangement 10 includes a housing arrangement 11 for defining a cavity 12, an elongated circuitous path through the cavity, and provisions (generally referred to at 15) for supporting an elongated fusible element 14 along the circuitous path. In a preferred arrangement, the housing arrangement 11 also includes provisions for defining dielectric shields in the form of barrier walls, e.g. 16,18 within the cavity 12 so as to further define cavity sections and the circuitous path. In a specific embodiment as shown in FIGS. 1–5, the housing arrangement is fabricated from the assembly of two individual housing portions, a first portion 20 and a second portion 22. However, it should be realized that in alternate embodiments the housing 11 arrangement is provided as a single element.

Regarding a preferred method for the general manufacture of the specific arrangement illustrated, the elongated fusible element 14 is disposed along the defined path in the first portion 20. The elongated fusible element 14 is fabricated and dimensioned along with the supporting provisions 15 and the path defined by the housing portion 20 such that a small amount of spring tension exists in the assembled position during fabrication. The cavity 12 is then filled with a pulverulent arc-quenching, fulgarite-forming filler material 24. The second portion 22 is then affixed to the first portion 20, with the material 24 being appropriately compacted for desirable performance to form fulgarites and quench arcs thereby during fuse operation when the fusible element carries currents above predetermined levels. The strength of the portions 20,22 forming the housing arrangement 11 as well as the attachment there between must be sufficient to withstand the temperatures and forces experienced during current-limiting operation and circuit interruption. In an alternate method of fabrication, the housing arrangement 11 is formed, such as in a molding process, as a single component so as to define the portions 20,22 about the fusible element 14. While the specific illustrative housing configuration 11 shown in FIGS. 1–5 is low-profile (i.e. a generally flat polyhedron) that is desirable from the manufacturing and product use standpoints, it should be realized that the present invention, in alternate embodiments, is applicable to provide various other path geometries and housing configurations.

In accordance with important aspects of the present invention, in addition to functioning as dielectric shields, the barrier walls 16,18 of the first portion 20 cooperate with the second portion 22 to provide additional strength and rigidity to withstand the pressure during current-limiting and current interruption operation. In a preferred embodiment, the second portion 22 includes defined provisions at 26 for alignment and cooperation with each of the barrier walls 16,18. Specifically, the provisions include a defined channel 28 formed between two protruding walls or ridges 30,32. During assembly, the top portions of the barrier walls 16,18 are affixed or joined to the walls 30,32 and the surface of the channel at 28 to provide additional rigidity and strength as well as appropriate dielectric seal between the compartments or sections. The dimensions of the barrier walls 16,18 and the features 28,30 and 32 are arranged so that the barrier walls 16,18 frictionally fit within the ridges 28,32 and contact the channel surface at 30 during assembly at the same time the outer rims 21,23 of the housing portions 20,22 respectively come into contact.

The dielectric shields provided by the barrier walls 16,18 allow the spaced apart portions of the elongated path of the fusible element 14 to be more closely spaced which provides additional length of path and element per unit space and a smaller overall size of the fuse arrangement 10. Thus, the spacing of the path segments can be determined and controlled in accordance with the area and volume of fulgarite-forming filler material that is required by the particular current-limiting function (in combination with the mechanical and thermal strengths and capabilities of the housing) and is not limited by the dielectric strength that would be provided by the filler material 24 alone, i.e. if the barrier walls 16,18 were not present, the path sections would be less closely spaced than illustrated in FIG. 2 if the filler material 24 alone was utilized to provide the necessary dielectric characteristics.

In accordance with important aspects of the illustrative embodiment of the present invention of FIGS. 1–5, it can be seen that the path is formed of generally U-shaped sections, i.e. each U-shaped section including two generally parallel legs or path segments spanned by a bight portion such that each of the generally parallel legs substantially spans the one of the major length or width dimensions of the housing 11. Thus the path length is much longer then the length or width, or the sum of the length and width of the housing 11. The present invention can also be practiced with paths and housings of diverse geometries. For example, the path of the fusible element 14 can be characterized as a plurality of serially interconnected non-aligned segments. While it is desirable from the standpoint of practical and efficient fabrication of the housing for the segments to generally define a plane, the invention can be suitably practiced without this constraint.

Figure 9:
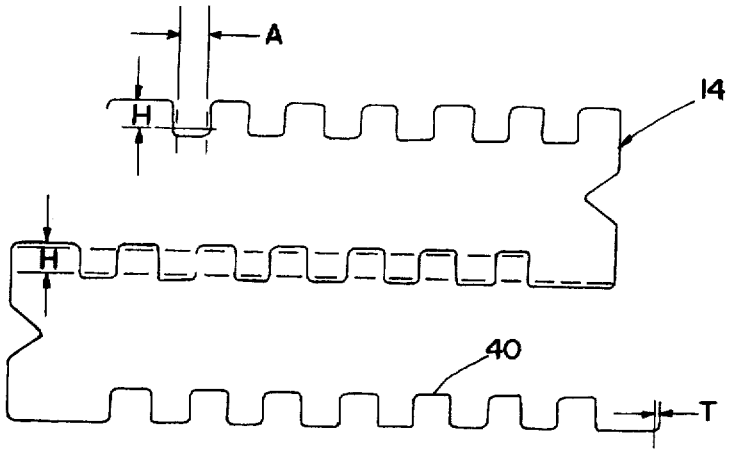
FIGS. 9 and 10 are respective top plan and right-side elevational views of an elongated fusible element usable with and shown in the fuse arrangement of FIG. 2.
Figure 10:
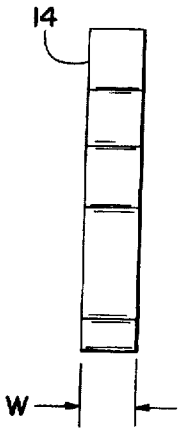
Figure 11:
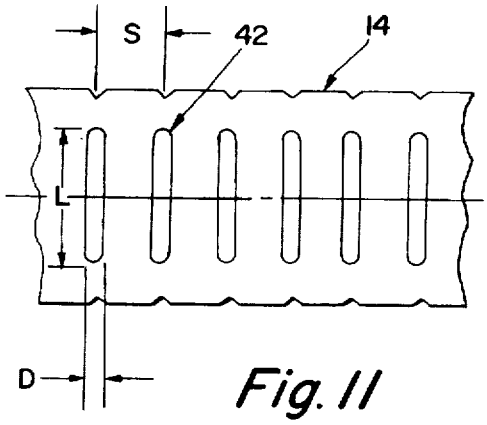
FIG. 11 is a partial top elevational view on an enlarged scale of portions of the fusible element of FIGS. 9 and 10.

With additional reference now to FIGS. 9–11, the fusible element 14 is an elongated, thin, conductive ribbon having a predetermined pattern of areas of reduced cross-section formed, for example, by holes 42, at which arcs are formed during current-limiting action and fault-current interruption as is well known to those skilled in the art. In a preferred arrangement and in accordance with important aspects of the present invention, in addition to the fusible element 14 being arranged in an elongated circuitous path as discussed hereinbefore, the fusible element 14 is also arranged to have a plurality of closely spaced departures from or bends along the path to substantially increase the length thereof. In a preferred arrangement, the bends or departures 40 are generally rectangular-shaped and arranged to form a path of contiguous or adjacent departures 40, i.e. two right angle bends in the same direction followed by two right angle bends in the opposite direction. For example, a fusible element 14 of total ribbon length in the range of 20–30 inches occupies a path length in the device 10 in the approximate range of 10–12 inches. It should be noted that each bend 40 can also be characterized as being provided by four bends out of a straight path and having two included angles that are approximately right angles.

This arrangement, in addition to increasing the path length of the fusible element 14, has also been found to increase current-limiting action, especially in combination with a close spacing of the areas of reduced cross-section. That is, for the same length of fusible element 14, a straight arrangement exhibits a higher let-through energy ($I^2t$) as compared to the pattern of bends 40 such that a longer fusible element 14 is required to achieve the same let-through effects as the pattern of bends 40. Thus, this feature synergistically reduces the path length measured through the housing 11, first due to the extra length of fusible element used in the bends 40 out of the straight line path, and secondly, the pattern of bends 40 lowers the let-through rating as compared to the same length of fusible element material disposed in a straight line path.

Additionally, a close spacing of the areas of reduced cross-section minimizes the size of fulgarite growth and results in fulgarite formations or sites that are uniform in cross-section and smaller in any one dimension. This allows for a smaller dimension of fulgarite material and thus a smaller size and volume of the housing 11.

For example, it has been found that a spacing on center along the fusible element 14 generally less than ¼ to ⅙ of an inch is desirable for holes 42 in the range of 1/20 to 1/40 of an inch in width as measured along the fusible element 14. Specifically, it has been found optimal to have a spacing on center of approximately ⅙–⅛ of an inch along the fusible element 14 for holes 42 of approximately 1/30 of an inch along the fusible element 14. Further, it has been found suitable to have the generally rectangular-shaped bends along the fusible element to be in the range of approximately ⅕–¼ of an inch. While the present invention can be practiced with the departure or dimension out of the path (as measured generally perpendicular to path of the fusible element 14) being almost any value that is limited only by the practicality and efficiency of forming and supporting the fusible element 14, for the present illustrative embodiment with housing 11 and circuitous path as shown in FIGS. 1–5, is has been found desirable to have this dimension of the departure out of the path to be generally about equal to or slightly less than the dimension along the path, i.e. it has been found desirable to have dimensions of the bends 40 as measured generally perpendicular to the path to be in the range of approximately ⅙ to ⅓ of an inch. These parameters correspond to a fusible element 14 for use and coordination with standard cutout fuse links of 10K to 20K, (Type K speed fuse links with current ratings of 10–20 amperes) with a melting $I^2t$ (amperes-squared-seconds) of approximately 5000–10,000 for use with the 10K–20K fuse links.

While this geometry and hole-spacings has a tendency to lower the continuous current which can be passed without overheating, it has significant benefits and does not detract from effective applications, e.g. transformer protection. For example, it has been found that fusible elements 14 can be fabricated with current ratings of 15 amperes or greater with a crossover current of 800 amperes (the crossover current defining the current level above which the device 10 will operate) and limiting potential fault currents in excess of 10,000 amperes to no more than approximately 5000 amperes peak. Fusible elements in accordance with the present invention may be fabricated from any suitable metal, e.g. copper, silver, aluminum etc. As an illustrative example as shown in FIGS. 9–11, a fusible element 14 fabricated from hard temper ETP copper has been found suitable for use with a standard 20K cutout fuse link of (20 ampere rating with K speed TCC) with the following parameters (in inches):

W=0.311 (Width of fusible element 14);

T=0.0045 (Thickness of fusible element 14);

L=0.185 (Expanse of hole 42 across W, in addition to 0.0065 on each edge);

D=0.032 (Expanse of hole 42 along fusible element 14);

S=0.117 (Spacing of holes 42 along fusible element 14);

A=0.211 (Length along path between bends 40);

H=(Amplitude or departure of bend 40 from path)—as determined to achieve desired length of path and consistent with path width of housing and fulgarite growth. In the illustrative example, H is in the range of 0.15–0.25.

Figure 2:
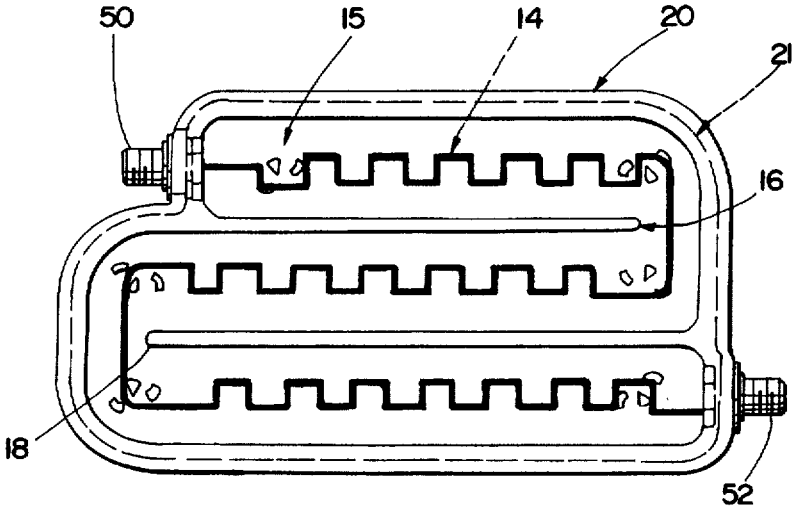
FIG. 2 is a bottom plan view with parts removed of the fuse arrangement of FIG. 1 taken along the line 2—2 of FIG. 1.
Figure 3:
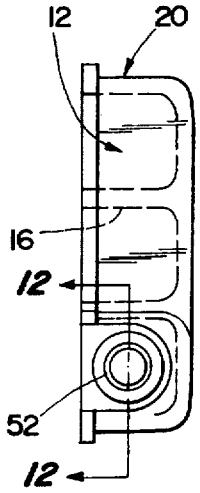
FIG. 3 is a right-side elevational view of the fuse arrangement of FIG. 1.
Figure 4:
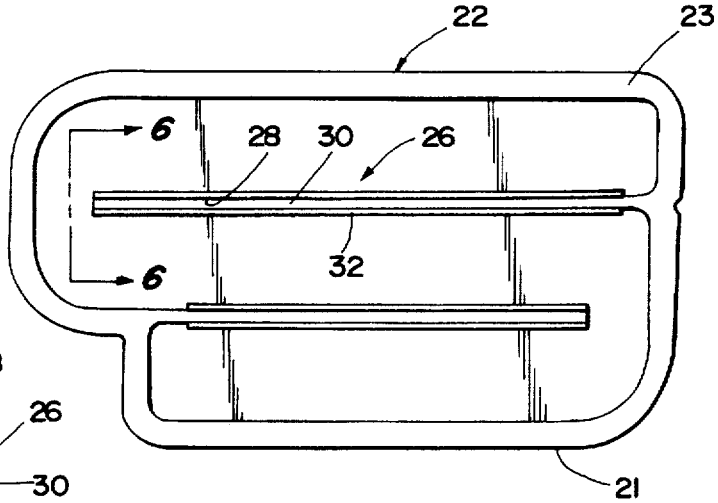
FIG. 4 is an elevational view of a cover portion of the fuse arrangement for use with the assembly of FIGS. 1–3 and as shown in FIG. 1.
Figure 5:
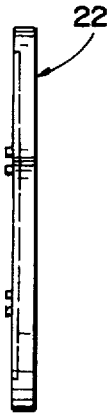
FIG. 5 is a right-side elevational view of the cover portion of FIG. 4
Figure 6:
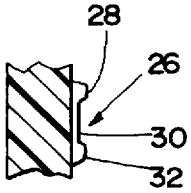
FIG. 6 is a partial sectional view taken generally along the line 6—6 of FIG. 4.
Figure 7:
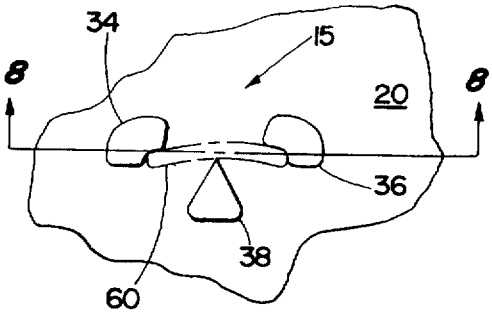
FIG. 7 is a partial, enlarged view of a support feature of the fuse arrangement as shown in FIG. 2.
Figure 8:
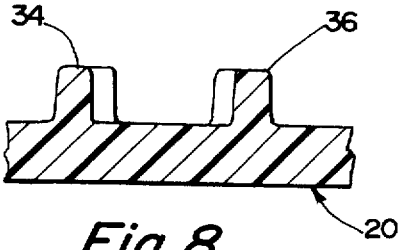
FIG. 8 is a sectional view of the support feature of FIG. 7 taken generally along the line 8—8 of FIG. 7.
Figure 13:
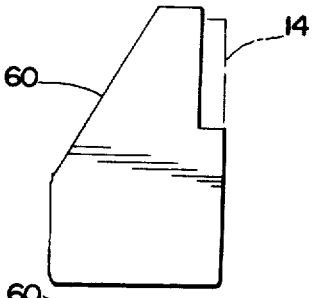
FIGS. 13 and 14 are respective front elevational and bottom plan views of a support element utilized with the fuse arrangement of FIGS. 1–12.
Figure 14:
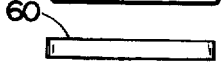

In the illustrative arrangement of FIGS. 1–3, and with additional reference now to FIGS. 7 and 8, the supporting provisions 15 include a predetermined pattern of protuberances, e.g. 34,36 and 38 to support and guide the element 14 as shown in FIG. 2. In a specific embodiment, and with additional reference to FIGS. 13 and 14, the supporting provisions additionally include element supports 60 and the protuberances 34,36 and 38 are utilized as element support locators to locate and retain a respective element support 60. The fusible element 14 is then supported and guided in its path by the element supports 60.

In a preferred process of manufacture, the portions 20,22 are attached to each other via vibration welding which has been found suitable to achieve the necessary bonding and housing integrity to maintain the housing 11 integral during fuse operation. In this manner, the vibration welding results in continuous bonding and attachment of the housing portions 20,22 at their interfaces, i.e. including the rims 21,23 of the housing portions 20,22 respectively and also the barrier walls 16,18 and the channel surface at 30. Additionally, the vibration welding is also beneficial because it provides desirable compacting of the filler material 24 to quench arcs. For example, before the vibration welding is started, the filler material 24 is introduced into the housing portion 20 at various locations around the housing portion 20 while compacting the material 24 via vibration or the like so that compacting is achieved during filling. The filler material 24 is filled and compacted so as to be at the top of the housing portion 20, e.g. struck off flush. Thus, when vibration welding is started to affix the housing portion 22 to the housing portion 20, the filler material 24 is further compacted and voids within the filler material 24 and between the housing portions 20,22 and the filler material 24 are reduced, the compaction occurring due to the weld penetration of approximately 0.020–0.040 of an inch. Of course, it should be realized that in other specific embodiments, the portions 20,22 are attached and a seal is achieved by other suitable means such as fasteners or adhesives and appropiate seal members. If vibration welding is utilized to close and seal the housing 11 of the device 10, the selected material also needs to be suitable for this type of process. While it is not required that a seal for the cavity 12 be maintained during or after current-interrupting operation, it is necessary to achieve and maintain a seal before operation to avoid the ingress of moisture from the environment. Further, it is also a desirable feature to maintain the seal throughout the current-interrupting function so that the device 10 is non-venting with no discharge or exhaust to the environment of any kind.

The housing portions 20,22 are preferably fabricated from a long glass fiber reinforced thermoplastic or polymer composite material that is suitable for injection molding of the portions 20,22. While the term long fiber is used, this is not to be confused with a continuous fiber process. A length of fiber of approximately ½ of an inch has been found suitable for injection molding while achieving approximately 98% of the strength of a long-fiber continuous process. Examples of materials that are suitable for this type of molding are polyphthalamide, polyethylene terephthalates, polyamides, polyether-imides, etc. A device 10 fabricated with approximate overall dimensions of 3.5"×5"×1.25" and a wall thickness for portions 20 and 22 of approximately 0.15" has been found suitable to interrupt currents in excess of 10,000 amperes at voltages in excess of 10,000 volts RMS.

Figure 12:
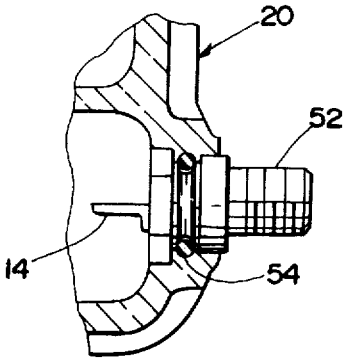
FIG. 12 is a partial sectional view on an enlarged scale taken generally along the line 12—12 of FIG. 3.

Referring additionally to FIG. 12, the fusible element 14 is connected at its end points to respective terminal connectors 50,52 to provide external electrical interconnections of the device 10 to suitable mating circuit or device connectors (not shown) of the circuit in which the device 10 is utilized. The ends of the fusible element 14 are suitably affixed and electrically connected to the terminal connectors 50,52 via resistance welding, ultrasonic bonding, soldering or other suitable process. Preferably, the terminal connectors 50,52 are incorporated into the device 10 during the molding of the overall device 10. In order to isolate the interior of the device 10 from the environment and to contain internally generated pressure and gas during fuse operation, sealing provisions 54 are provided at the interface of the terminal connectors 50,52 and the housing portion 20 so as to form a seal at the time of fabrication during the molding process, as disclosed and claimed in copending application Ser. No. 08/227,202 to which reference may be made for a more detailed discussion. In the specific embodiment illustrated in FIG. 5, the sealing provision 54 is an O-ring that is positioned over the terminal connectors 50,52 before molding.

Figure 15:
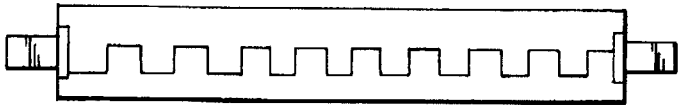
FIG. 15 is a diagrammatic view of an another device in accordance with the principles of the present invention.
Figure 16:
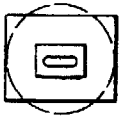
FIGS. 16 and 17 are diagrammatic side views of FIG. 15.
Figure 17:
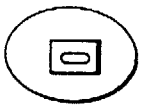
Figure 18:
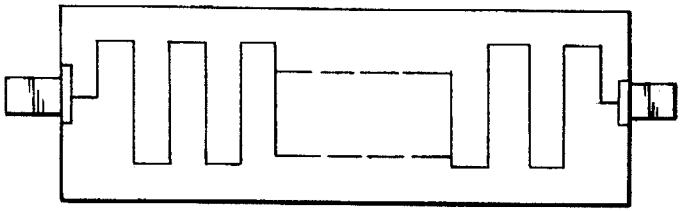
FIGS. 18–20 are diagrammatic views of three other alternative devices in accordance with the principles of the present invention.
Figure 19:
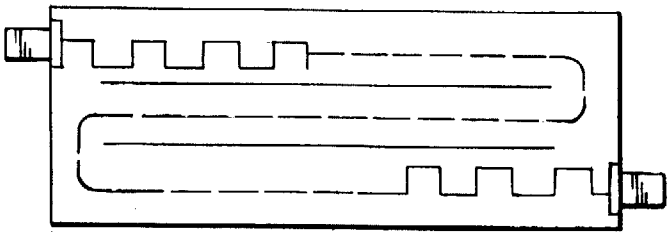
Figure 20:
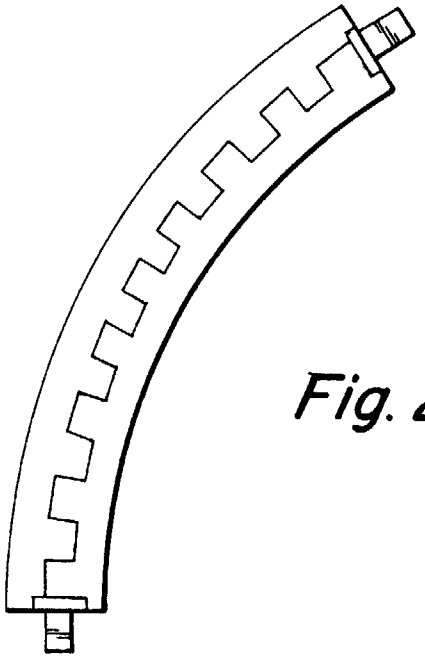

Considering other specific embodiments of the present invention, it should be understood that the principles of the present invention are applicable to paths for fusible elements and housings therefor of various and diverse geometry. For example, while it is advantageous from the standpoint of reducing the overall length of the housing to utilize a path that is circuitous, i.e. serial interconnected non-aligned segments, the invention can also be practiced by use of paths that are single segment straight line or curvilinear paths, where the path includes a pattern of areas of reduced cross-section that are closely spaced so as to reduce the required volume of surrounding fulgarite material via generally uniform fulgarite sites of minimal size. Accordingly, the cross-section of the housing can be rectangular, round, oval etc., with the cross-section of minimum area being defined by the required space for the fulgarite sites. Since the requirements to surround the fulgarite sites along the path define the minimum requirements for the cross-section of the housing, a housing of minimal size for a given path will have a cross-section that follows the direction of the path. Further, where it is desirable to optimize current-limiting action and achieve a predetermined let-through energy while minimizing the path length of the fusible element through the housing, the present invention teaches closely spaced bends or departures out of the path to maximize the length of the fusible element along the path and to increase current-limiting action, each of the closely spaced bends or departures being defined by at least three adjoining segments that are out of the path of the fusible element and that do not intersect the path. Additionally, although the generally planar path does lend itself to efficient housing configurations, a plurality of segments defining the path are not required to generally define a plane. From FIGS. 1–5, it can be seen that the path segments defined by the path of the fusible element 14 and the barrier walls 16,18 generally define the cross-section of the housing surrounding the path, i.e. the device 10 can be visualized as three interconnected linear sections (straightening of the "U" portions) such as could be formed by three housings or one long narrow housing. Referring now additionally to FIGS. 15–20, other specific embodiments of fuses in accordance with the principles of the present invention and discussed hereinabove are shown. For example, FIG. 15 illustrates a single segment path where the housing is relatively long and narrow, having any of various cross-sections, e.g. rectangular (FIG. 16), oval (FIG. 17), or circular (phantom in FIG. 16). An example of a path where the bends or departures are much larger off the path compared to the spacing along the path is illustrated in FIG. 18. The configuration of the path in FIG. 19 illustrates the circuitous path with U-shaped portions as in FIGS. 1–5. Note that the housings in both FIGS. 18 and 19 are the same dimensions whereas the paths are quite different. The arrangement of FIG. 20 illustrates a curvilinear path segment and a housing that follow the shape of the path.

While there have been illustrated and described various embodiments of the present invention, it will be apparent that various changes and modifications will occur to those skilled in the art. Accordingly, it is intended in the appended claims to cover all such changes and modifications that fall within the true spirit and scope of the present invention.

What is claimed and desired to be secured by Letters patent of the United States is:

1. A current-limiting fuse for medium-voltage electrical power distribution comprising:

housing means for defining a cavity of predetermined dimensions;

an elongated fusible element;

means for defining an elongated circuitous path through said cavity and for supporting said elongated fusible element along said elongated circuitous path, said elongated circuitous path of said elongated fusible element including a plurality of serially interconnected non-aligned segments that generally define a plane;

means for electrically connecting said elongated fusible element between at least two points on the periphery of said housing means; and pulverulent arc-quenching filler material surrounding said elongated fusible element and generally filling said cavity, said elongated fusible element comprising a flat thin ribbon of conductive material including an edge-wise configuration that defines a series of generally rectangular-shaped departures from said elongated circuitous path and said plurality of serially interconnected non-aligned segments, each of said generally rectangular-shaped departures being formed by a first two generally right-angle bends followed by a second two generally right-angle bends in the opposite direction to said first two generally right-angle bends.

2. The current-limiting fuse of claim 1 wherein said elongated fusible element includes a predetermined pattern of areas of reduced cross-section spaced along its length, said predetermined pattern including spacing said areas of reduced cross-section at approximately 1/6 of an inch or less.

3. The current-limiting fuse of claim 2 wherein said elongated fusible element includes a predetermined pattern of areas of reduced cross-section spaced along its length, said predetermined pattern including spacing said areas of reduced cross-section at approximately 1/8 of an inch or less, said area of reduced cross-section being provided by holes through said elongated fusible element that have a dimension of 1/20 to 1/40 of an inch as measured along said elongated fusible element.

4. The current-limiting fuse of claim 1 wherein said housing means and said path-defining means comprise means for defining dielectric barriers between those segments of said plurality of serially interconnected non-aligned segments of said circuitous path that are not immediately adjacent or connected to each other.

5. A current-limiting fuse comprising:

housing means being a generally flat polyhedron comprising at least two housing portions for defining a cavity of predetermined dimensions having overall length L, width W, and height H;

means for defining an elongated circuitous path through said cavity, said elongated circuitous path generally defining a plane and including two or more U-shaped path portions, each of said U-shaped path portions including two generally parallel legs spanned by a bight portion;

an elongated fusible element being disposed along said elongated circuitous path;

means for electrically connecting said elongated fusible element to at least two points on the periphery of said housing means; and pulverulent arc-quenching filler material surrounding said elongated fusible element and generally filling said cavity.

6. The current-limiting fuse of claim 5 wherein said housing means and said path-defining means comprise means for defining dielectric barriers between said generally parallel legs.

7. The current-limiting fuse of claim 6 wherein said dielectric-barrier defining means comprises cooperating means carded by said housing portions for forming a continuous barrier wall between said housing portions.

8. The current-limiting fuse of claim 7 wherein said cooperating means comprises interfitting structure of said housing portions.

9. The current-limiting fuse of claim 5 wherein one of said housing portions comprises upstanding wall members arranged between said generally parallel legs.

10. The current-limiting fuse of claim 5 wherein said elongated fusible element is a flat thin ribbon of conductive material and includes a predetermined spaced pattern of areas of reduced cross-section, said elongated fusible element being formed to define along and with respect to said elongated circuitous path undulations that are formed by four bends with two included angles that are approximately right angles, the expanse of said undulations along said path being generally equal to the distance between successive undulations.

11. The current-limiting fuse of claim 5 wherein said elongated fusible element is a conductive ribbon being formed so as to define tooth-like projections along said path that depart generally perpendicularly to said path.

12. An elongated current-limiting fusible element for a medium-voltage electrical power distribution fuse having a predetermined cross-section defined by a width and a thickness, said elongated fusible element further comprising areas of reduced cross-section spaced in a predetermined pattern along said elongated current-limiting fusible element, said elongated fusible element being formed in a predetermined pattern to define when viewed edgewise a series of departures from said elongated fusible element, each of said departures being formed by a first two generally right-angle bends followed by a second two generally right-angle bends in the opposite direction to said first two generally right-angle bends, said generally square-shaped departures having an expanse as measured along said elongated fusible element of approximately 1/4 to 1/5 of an inch and having a dimension defining the departure in a direction generally perpendicular to said elongated fusible element of approximately 1/6 to 1/4 of an inch.

13. An arrangement in a medium-voltage electrical power distribution fuse for maximizing the length of a path for a fusible ribbon within a low-profile housing that has generally planar top and bottom surfaces that are generally parallel, the arrangement comprising means for defining a path formed by a plurality of serially connected segments which are all generally in the same plane and wherein successive segments are defined by a change in direction to define a circuitous path that weaves its way through said low-profile housing, said path being further defined by tooth-like departures of said fusible ribbon extending generally perpendicular away from said segments.

14. An elongated current-limiting fusible element for a medium-voltage electrical power distribution fuse defining an elongated direction and having a predetermined cross-section defined by a width and a thickness, said elongated current-limiting fusible element further comprising areas of reduced cross-section spaced in a predetermined pattern along said elongated direction of said current-limiting fusible element, said elongated current-limiting fusible element being formed in a predetermined pattern to define when viewed edgewise a series of undulations away from said elongated direction of said elongated current-limiting fusible element, each of said undulations being defined by at least three adjoining segments that depart from said elongated direction of said elongated current-limiting fusible element and that do not intersect said elongated direction, said undulations being sufficiently closely spaced over substantially the entire length of said elongated current-limiting fusible element so as to increase current-limiting action and lower the current let-through rating as compared to a fusible element without undulations, said undulations being defined by an expanse of less than 1/4 of an inch as measured along said elongated direction and being spaced so as to define an expanse of less than 1/4 of an inch along said elongated direction between successive undulations.

* * * * *

UNITED STATES PATENT AND TRADEMARK OFFICE

CERTIFICATE OF CORRECTION

PATENT NO. : 5,604,475

DATED : Feb. 18, 1997

INVENTOR(S) : Hiram S. Jackson

It is certified that error appears in the above-identified patent and that said Letters Patent is hereby corrected as shown below:

Col. 5, line 60, "is" should be -- it --;

Col. 6, line 19, after "fuse link" delete -- of --; and

Col. 9, line 54, claim 7, "carded" should be -- carried --.

Signed and Sealed this

Thirteenth Day of April, 1999

*Attest:*

Q. TODD DICKINSON

*Attesting Officer*

*Acting Commissioner of Patents and Trademarks*